US006988952B1

(12) United States Patent
Hagerty

(10) Patent No.: US 6,988,952 B1
(45) Date of Patent: Jan. 24, 2006

(54) POOL SLIDE

(76) Inventor: Michael J. Hagerty, 3050 S. Alvernon Way, Tucson, AZ (US) 85713

( * ) Notice: Subject to any disclaimer, the term of this patent is extended or adjusted under 35 U.S.C. 154(b) by 0 days.

(21) Appl. No.: 10/925,075

(22) Filed: Aug. 23, 2004

(51) Int. Cl.
*A63G 21/10* (2006.01)

(52) U.S. Cl. ..... 472/116; 472/117

(58) Field of Classification Search ..... 472/116, 472/117, 128, 136, 137; 482/35, 36; 104/69, 104/70; 182/48, 49
See application file for complete search history.

(56) References Cited

U.S. PATENT DOCUMENTS 4,194,733 A 3/1980 Whitehouse, Jr.
4,270,748 A * 6/1981 Ray ..... 472/116
4,299,171 A * 11/1981 Larson ..... 104/70
4,379,551 A 4/1983 Ahrens
4,805,898 A 2/1989 Jacober et al.
4,811,943 A 3/1989 Ahrens
5,407,393 A 4/1995 Schmidt
5,427,574 A * 6/1995 Donnelly-Weide ..... 472/116
5,478,281 A 12/1995 Forton
5,860,867 A * 1/1999 Van Deusen ..... 472/116
5,865,679 A 2/1999 Seabolt et al.
6,575,840 B2 6/2003 Hagerty

* cited by examiner

*Primary Examiner*—Kien Nguyen
(74) *Attorney, Agent, or Firm*—Joseph W Mott; Jennings Strouss & Salmon PLC

(57) ABSTRACT

A swimming pool slide capable of assembly in a plurality of configurations is disclosed. The slide body comprises a seat segment, a runway segment and an exit segment, the runway segment being attachable to the other two segments in more than one orientation, thereby varying the configuration of the slide.

7 Claims, 9 Drawing Sheets

Fig. 8
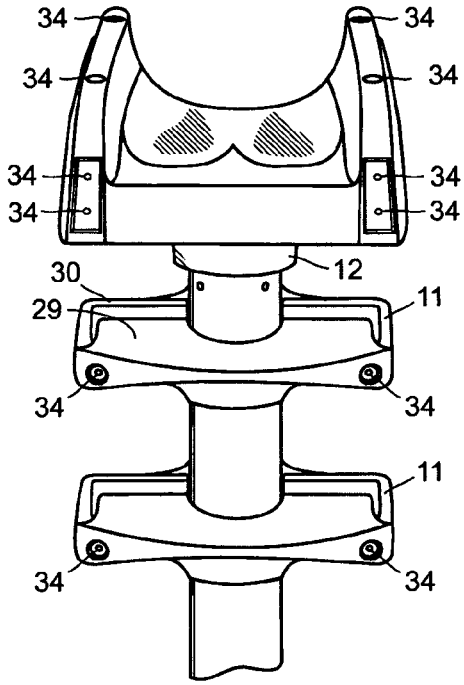
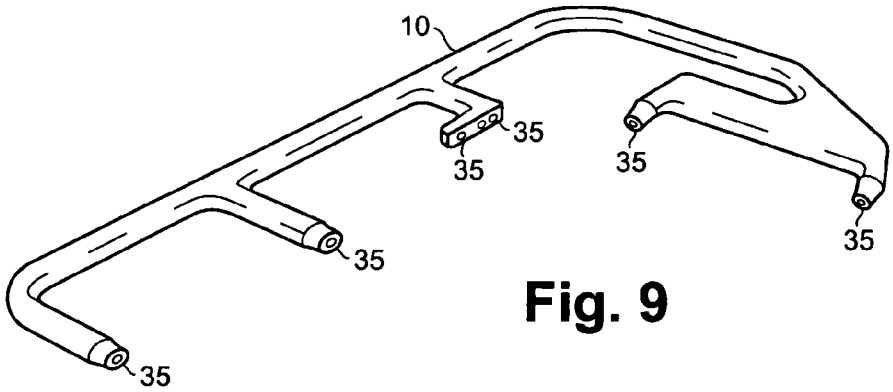
Fig. 9

POOL SLIDE

BACKGROUND OF THE INVENTION

Swimming pool slides for recreation and amusement are well known and typically comprise a ladder, a platform or seat at the top of the ladder, a runway down which the user slides, and an exit into a pool of water. To decrease friction between the runway surface and the user, many slides include a source of water flowing from the top of the runway.

Pool slides for in-ground backyard pools are generally adapted to mount on the pool deck. They may be straight slides, in which the ladder and runway is perpendicular to the side of the pool, or curved slides, in which the user starts at an angle to the pool side and is carried along a curved path that exits perpendicular to the side of the pool. The height of the slide ladder may vary, starting from about three feet. Eight feet is generally the maximum ladder length for home pools, while substantially longer ladders, with high platforms, are used in community or public recreation pools.

For curved pool slides, the configuration of the pool and deck area constrains the configuration and directional orientation of the slide itself. For example, some locations would only accommodate a left-turn slide in the portion of the deck planned for slide installation. It would be more efficient for slide retailers to have a modular slide structure accommodating different directional orientations, so that either a left- or right-turn slide can be assembled from the same set of components, thus avoiding the need to inventory both slide configurations. Similarly, it would be advantageous to have a modular two-turn slide structure that may be assembled in a left-right or right-left directional orientation.

SUMMARY OF THE INVENTION

A modular design for a backyard swimming pool slide is provided. Components include a ladder, a seat or upper platform, a slide runway and an exit ramp. The slide runway, in one or more pieces, fits between the seat and the exit ramp in different orientations, allowing varying configurations of the slide while using the same set of components. Lubricating water flow may be added by injecting water at the seat.

BRIEF DESCRIPTION OF THE DRAWINGS

FIG. 8 shows a closeup of the seat section and steps mounted on the ladder tube, but with the ladder handrail removed.

FIG. 9 shows the ladder handrail.

DETAILED DESCRIPTION OF THE INVENTION

Figure 1:
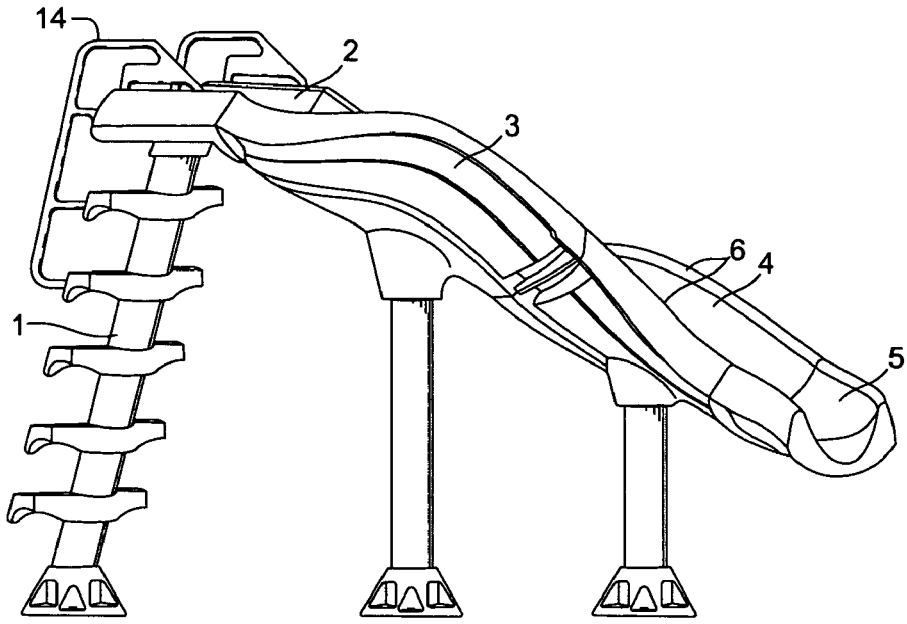
FIG. 1 is a perspective view of one embodiment of the slide of the current invention.
Figure 2:
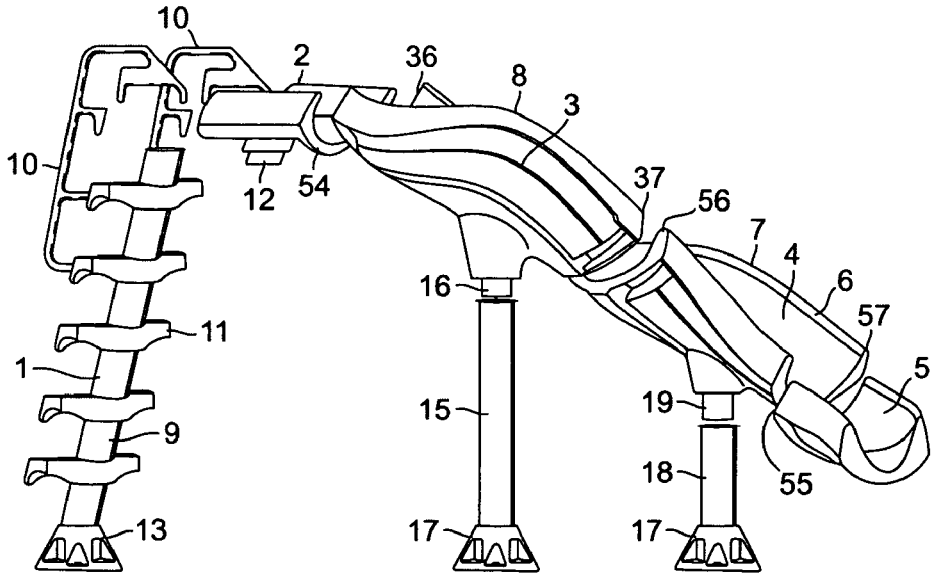
FIG. 2 is an exploded view of the slide of FIG. 1.
Figure 3:
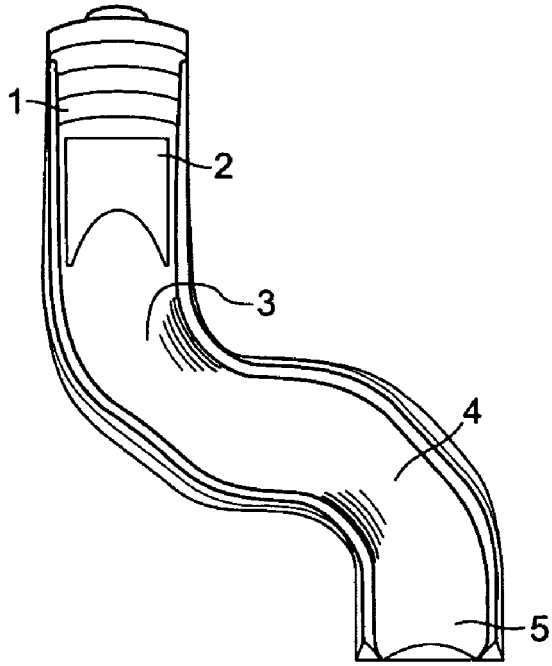
FIG. 3 is a plan view of the slide of FIG. 1 in which the first turn of the runway is a left turn.
Figure 4:
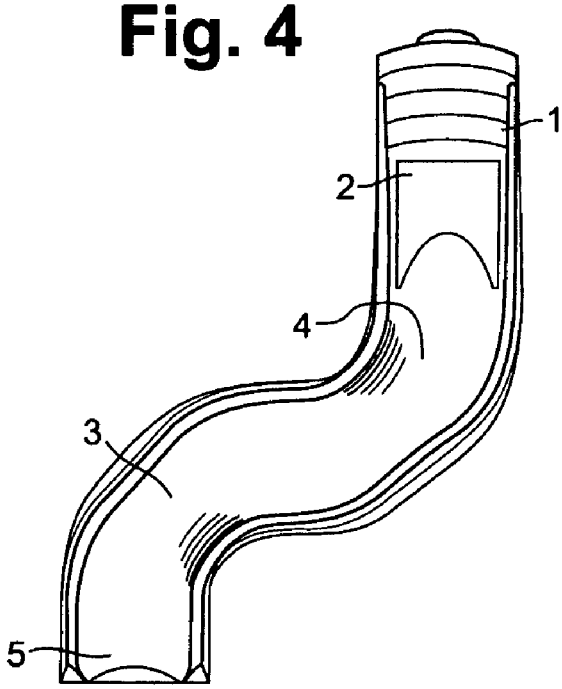
FIG. 4 is a plan view of the slide of FIG. 1, assembled so that the first turn of the runway is a right turn.

In the preferred embodiment, shown in FIGS. 1 and 2, seating section (2) is positioned about 6 feet above the ground. Ladder (1) is oriented perpendicular to the edge of the pool, at an approximate 74° vertical angle from the deck. The runway, comprised of a left turn section (3) and a right turn section (4), curves through 62° of arc, reverses and curves through an additional 62° of arc, so the runway exit (5) is approximately parallel to the runway entrance and perpendicular to the pool edge. The curvature may either be left/right-handed (FIG. 3) or right/left-handed (FIG. 4), depending on the desired positioning of the two runway sections.

The slide body, shown in FIG. 2, comprising the seat (2), the curved sections (3, 4) and the exit (5), is made of Polyethylene (such as ExxonMobil LLP8555.25 35 mesh powder) with long term UVB stabilization utilizing a rotational molding process. For most of the slide length, the runway rails (6), integral with the slide body, are approximately 9" high above the lowest point of the runway surface, providing safe confinement of the user and an optional handhold. The outside runway rail on the convex side of each curved section transitions from the typical height to a height that is substantially elevated, approximately 16" high above the lowest point of the runway surface at regions (7), (8) constituting the center of curvature. This allows the user under centrifugal force to ride slightly up the wall, as in a banked turn, giving a toboggan-like ride and decreasing the likelihood of falling off the slide.

Figure 5:
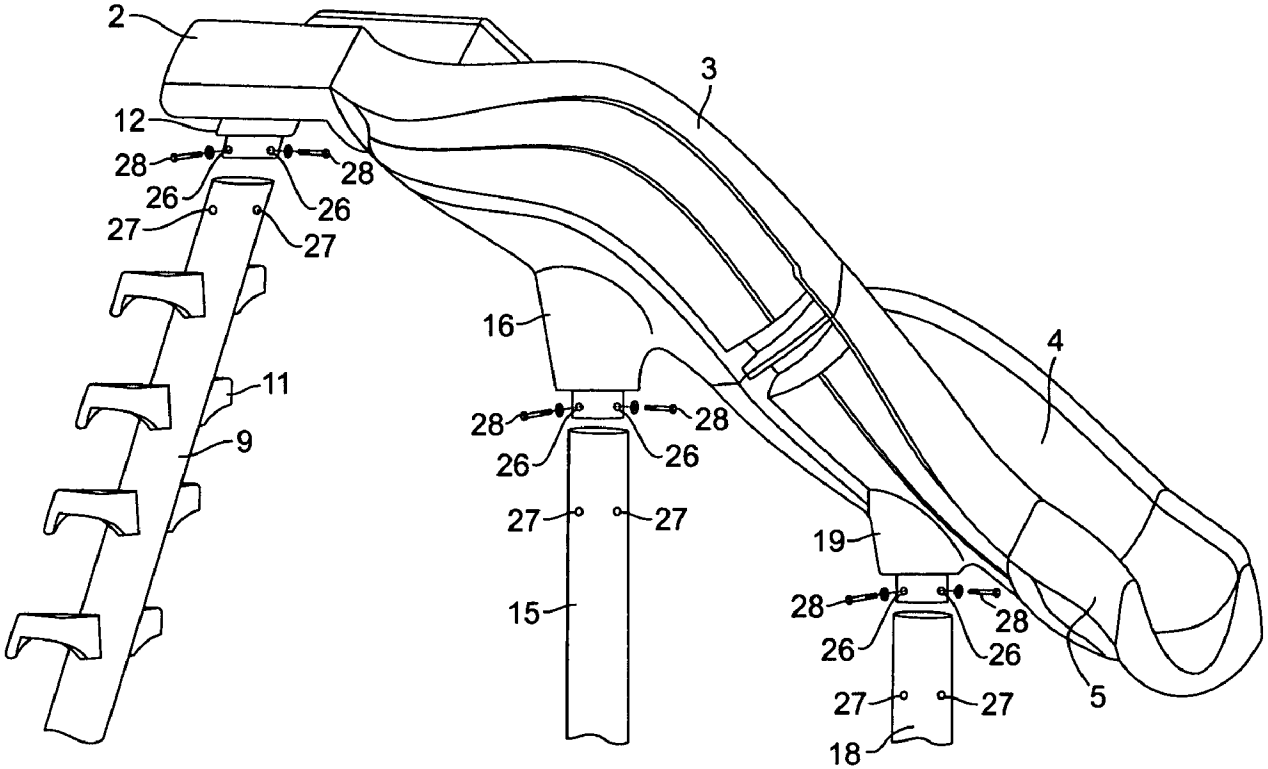
FIG. 5 is an exploded view showing the stanchion support connections.
Figure 6:
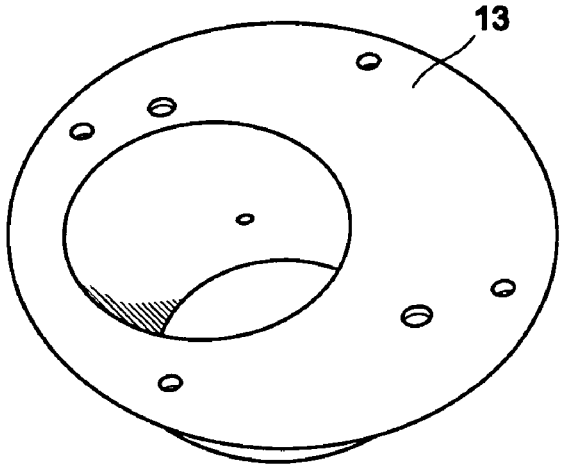
FIG. 6 shows the underside of the base plate for the ladder support tube.

The slide of the present invention also includes an improved ladder and handrail configuration, as shown in FIGS. 1 and 2. Ladder (1) is of a non-standard type, consisting of a single, large, tubular support (9), a pair of handrails (10), and five steps (11). The large diameter ladder support tube (9), consisting of a 6" PVC tube approx 65" in length, is attached to the seating section by slipping the ladder support tube into the ladder stanchion receiver (12) molded into the underside of the seating section (2). As may be seen in FIG. 5, the stanchion receiver (12) includes imbedded nuts (26) that align with apertures (27) in the ladder support tube (9) and secure with four bolts (28). The ladder support tube is then bolted to a base plate (13) manufactured of the same material as the slide, which itself is bolted to the deck. As seen in FIG. 6, the base plate 13 is internally molded to receive the ladder support tube at an approximate 74° angle, while providing a flat mounting surface to the deck.

Figure 7:
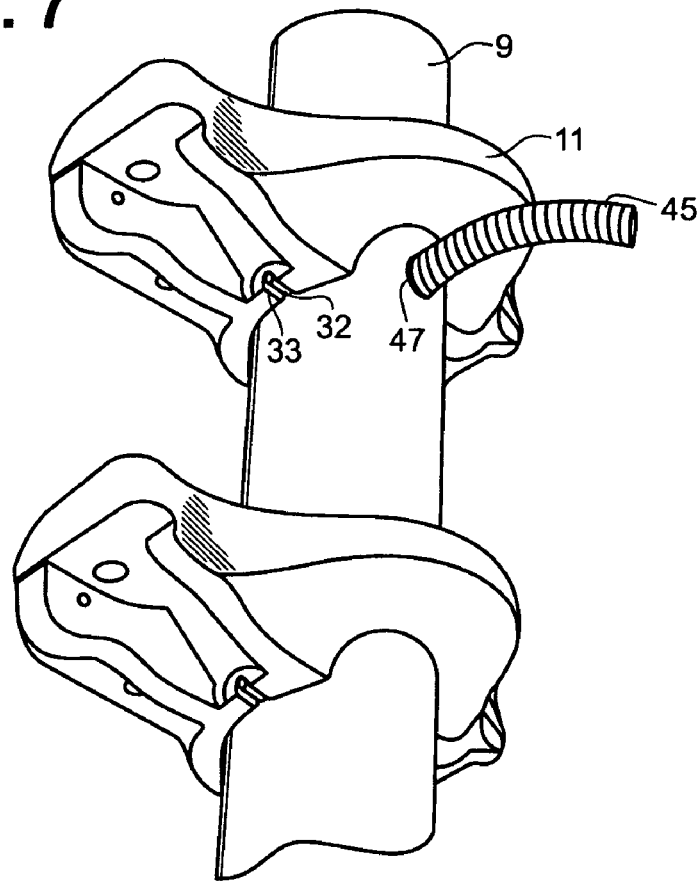
FIG. 7 shows the ladder support tube and the underside of a step.

The steps (11), shown in detail in FIGS. 7–8, of an unconventional design, are approximately 12.5" wide, 22" long and 5" deep. They have a molded, ribbed, non-slip surface (29) and a 1" molded lip around the sides and rear (30) preventing the user's foot from slipping off the step. These steps attach to the ladder support tube by first inserting a ⅜"×9.25" nylon dowel (33) perpendicular through an aperture in the ladder support tube, then sliding the step down the ladder support tube through the approx 6.5" center hole (31) molded into each step. The underside of the step has a molded notch (32), which tightly snaps onto the nylon dowel (33); the locking of the notch to the nylon dowel prevents the step from slipping down. Handrails (10), shown in FIGS. 2 and 9, attach to the top two steps and the seating section. A total of six apertures (34) for each handrail in the steps and seating section, each of which is recessed (33) slightly, align with imbedded nuts (35) within the handrails and are bolted on. The handrails extend about 8" (14) above and along the edge of the seating section, creating a runway side rail on each side of the seating section, providing a safe transition from standing to sitting.

The modularity that allows runway reversibility is seen in FIGS. 2 and 10–13. Each of the two runway sections (3, 4) has an upslide end (36, 56) and downslide end (37, 57), respectively. The seating section (2) has a downslide end (54) and the exit section (5) has an upslide end (55). For a slide configuration that starts with a right turn, runway section (4) is the upper runway section and runway section (3) the lower section. For a slide that starts with a right turn, runway section (3) is the upper section and runway section (4) the lower section.

The upslide ends of both runway sections can mate to the downslide end (54) of the seat section, and the downslide ends of both runway sections can mate to the upslide end (55) of the exit section. Finally, the upslide end of either runway section can mate to the downslide end of the other runway section.

Figure 10:
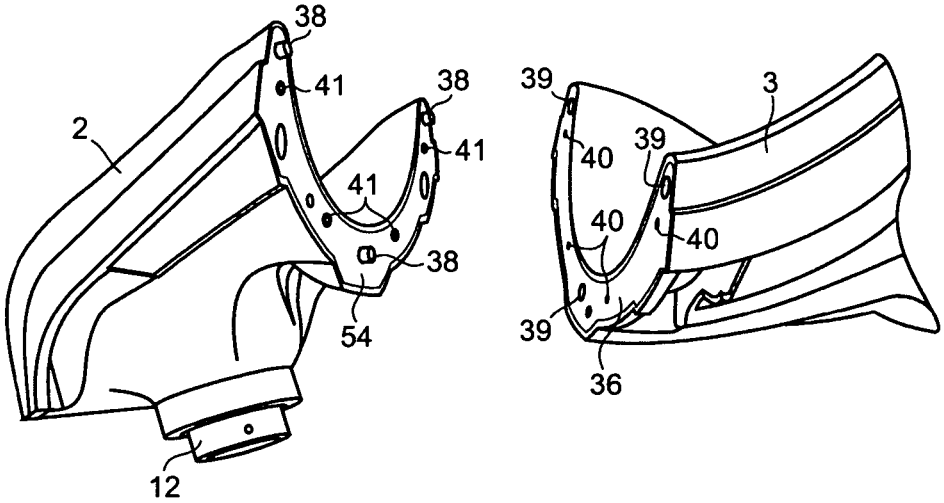
FIG. 10 shows the matching parts of the seat section and one of the runway sections.

As seen in FIG. 10, the downslide end of the seating section has molded circular, rounded bosses (38) and the matching upslide end of the runway section has molded circular indentations (39). The bosses align and lock into the indentations, ensuring the correct alignment and configuration of the slide runway sections.

Figure 11:
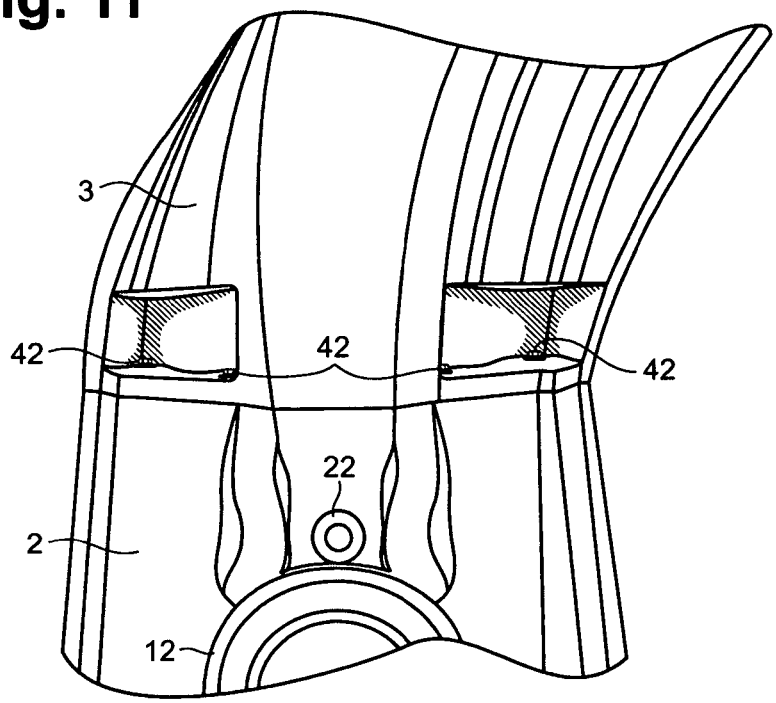
FIG. 11 shows from below the connection of the seat section to a runway section.

Additionally, the upslide end (36) of upper runway section (3) has apertures (40) that align with imbedded nuts (41) located on the downslide end (54) of the seating section (2) and is attached with four bolts (42), as seen from below in FIG. 11.

Figure 13:
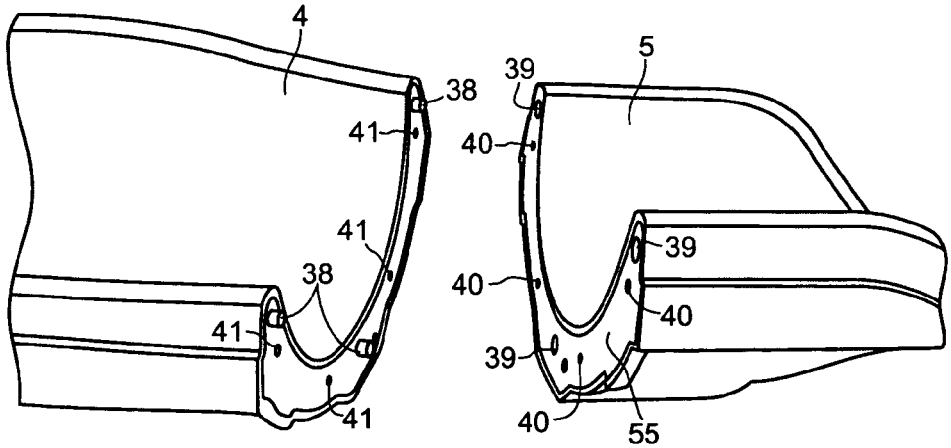
FIG. 13 shows the matching parts of a runway section and the exit section.

The same structure for mating, namely, bosses (38), indentations (39), apertures (40), embedded nuts (41) and bolts (42) permit connection of the two runway sections together (not shown) and the connection of the downslide end of a runway section with the upslide end (55) of exit section (5), illustrated in FIG. 13.

Figure 12:
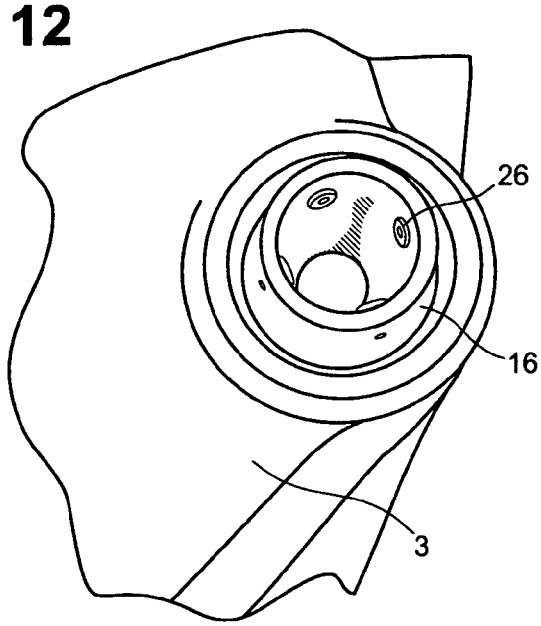
FIG. 12 shows a stanchion receiver on one of the runway sections.

As shown in FIG. 2 the upper runway section (3) receives further vertical support from a large diameter stanchion (15) (6" PVC approx. 49" in length) that is attached to the upper runway section by inserting the stanchion tube into the stanchion receiver (16), which is molded into the runway section. The lower runway section (4) is also supported by a large diameter stanchion (18) (6" PVC pipe approx. 25" long) that is attached to the lower runway section by slipping the stanchion into the molded stanchion receiver (19). As seen in FIG. 5 and FIG. 12, the stanchion receiver on both the upper and lower runway sections is molded with a semi-conical center that allows the stanchion tube to be aligned within the stanchion receiver at a 90° angle to the deck. In the fully assembled runway, providing for reversibility, the combination of curve and slope necessitates the support stanchion be adjustable to a 90° angle within the stanchion receiver itself on both the runway sections as the vertical angles of the stanchion receivers are slightly different when the two runway sections are reversed. Also, pool decks are not always 90° to the stanchion receiver, some decks sloping away from the pool. The stanchion receiver includes imbedded nuts (26) that align with apertures (27) in the stanchion tube and secure with four bolts (28). The stanchion tube is then mounted to a base plate (17), which itself is bolted to the deck.

As seen in FIG. 10, the downslide end (54) of the seating section and the upper and lower runway sections (37, 57) have a molded recess (43) containing a foam gasket (44) that prevents the runway from leaking.

Figure 14:
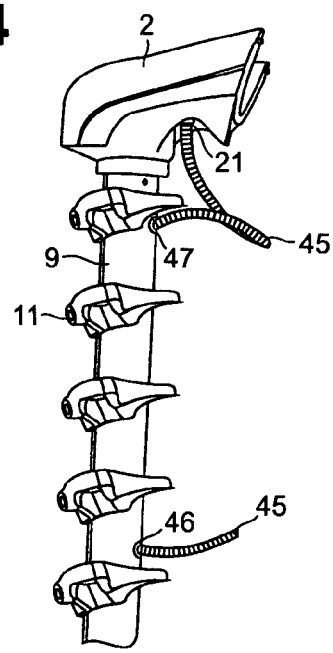
FIG. 14 shows the water delivery piping to provide water to the seat to lubricate the ride.
Figure 15:
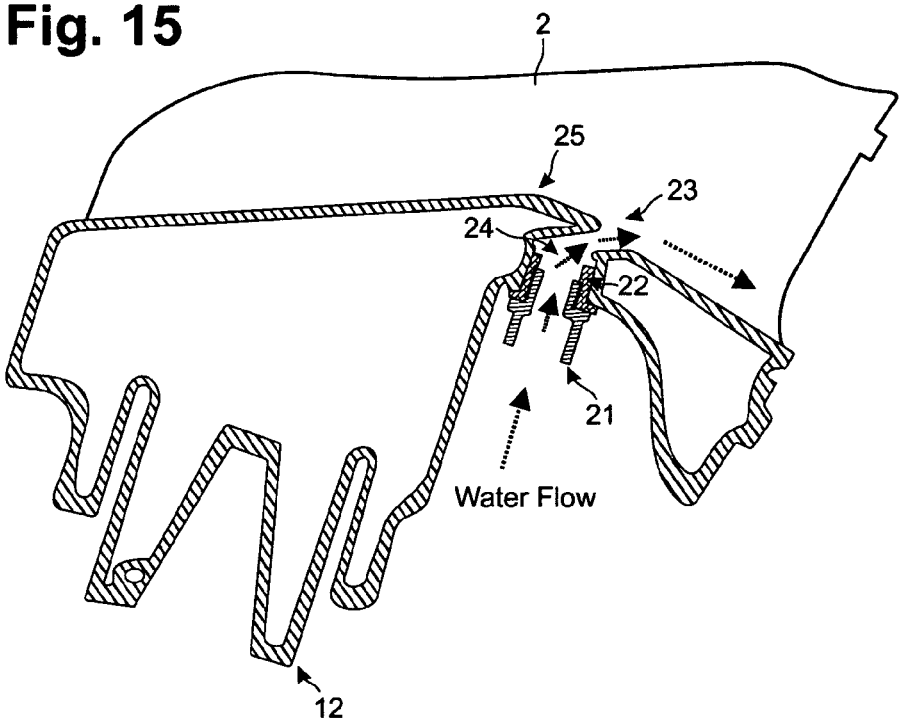
FIG. 15 is a cutaway view of the seat section showing the water flow system.

As shown in FIG. 14 the water lubricating system is comprised of about 10 feet of 1" flexible PVC pipe (45) that is inserted into a hole (46) in the inward side of the ladder support tube slightly above the first step. The flex pipe is threaded up the ladder support tube to another hole (47) located above the top step on the inward side of the ladder support tube, providing a safe, enclosed and cosmetically appealing conduit for the water delivery piping. The flex pipe is pulled from the exit hole parallel to the underside of the seating section to about midway of the seating section, attaching to a male 1" fitting (21) that is threaded into a 1" female threaded fitting (22) that is bonded into a single, one-piece, integrated diffusing cavity (24) molded into the seating section, as shown in FIG. 15. The diffusing cavity (24) is fashioned in such a way as to form an opening (23) in the runway surface of the seating section slightly below the start of the downward slope of the runway on the seating section (25) transversely crossing the center of the trough of the slide. The effect is a high-volume, umbrella-shaped flow of water distributed across and then down the trough of the slide, affording heightened anti-friction lubrication for users and a fast ride.

Another embodiment of the invention comprises a slide with a single turn, typically through anywhere between 60° and 90° of arc. Shown in FIGS. 16–17, this slide is modular so that it may be assembled in a right-turn or left-turn configuration, depending upon the layout of the pool and deck or the preference of the owner.

The slide body is made up of a seating section (102), a runway section (103) and an exit section (104). The runway section is reversible so that either of the runway section ends (107, 108) can mate to the seating section or to the exit section, depending on the selected direction of curvature. While this embodiment can have a ladder design, slide body cross section and support similar to those in the previously-described embodiment, a simpler design is illustrated here.

Figure 16:
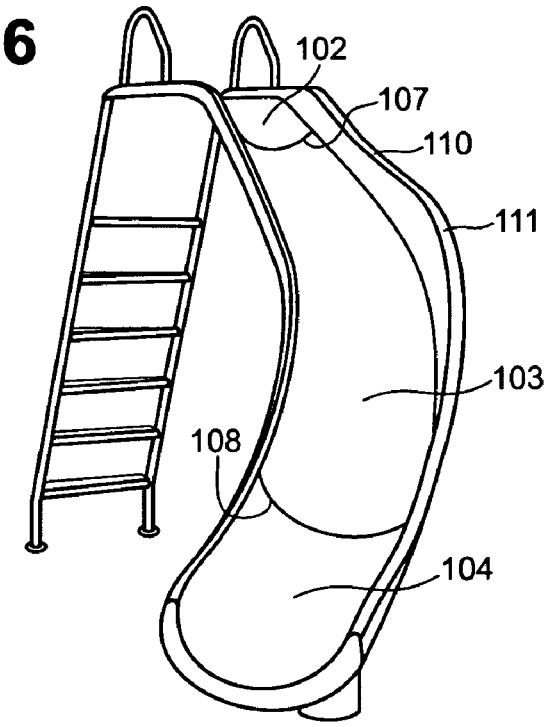
FIG. 16 shows a different embodiment, comprising a slide with a single curve runway.

Turning to FIG. 16, the slide is made up of a ladder portion (101), a seating section (102), a runway section (103) and an exit section (104). As illustrated, the ladder is similar to the ladder configuration described in U.S. Pat. No. 6,575,840. The slide body is made of conventional recreational pool slide materials and has integrated side rails of conventional height and a slide trough. The curved runway section incorporates on its convex side a side rail (110) that starts at conventional height, transitions to a substantially increased height at the center of the curve (111) and transitions back to conventional height at the opposite end of the section.

Figure 17:
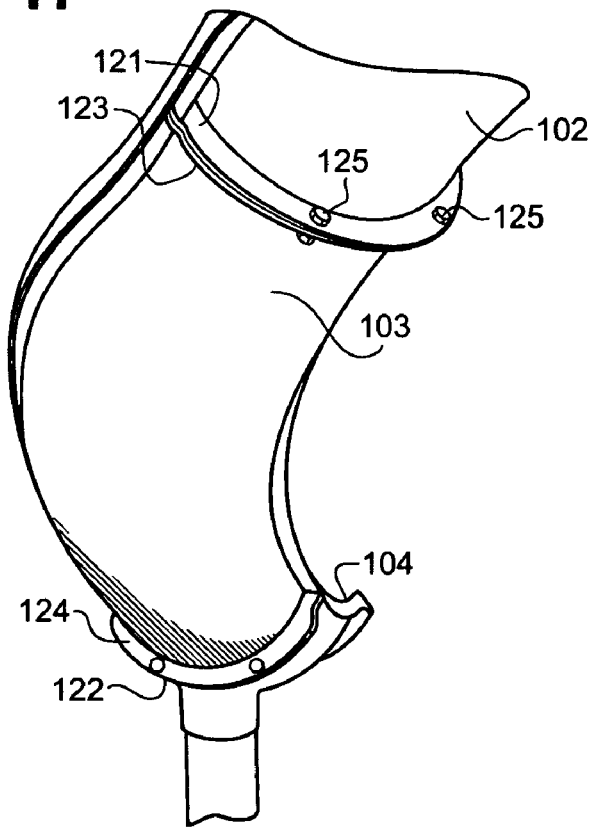
FIG. 17 shows the slide of FIG. 16 from below.

As seen from below in FIG. 17, the seating section (102) incorporates a flange (121) under its downslide end, while the exit section (104) incorporates a matching flange (122) on its upslide end. The runway section (103) has flanges (123, 124) under both of the ends. The three sections are joined together by bolts (125) through apertures in the flanges.

Because either end of the runway section may be positioned as the upslide end, and because either end of the runway section may securely attach to the seating section or to the exit section, the slide may be easily configured as a left-turn or right-turn slide.

Support in the illustrated embodiment is provided by the ladder at one end and a stanchion, similar to that in U.S. Pat. No. 6,575,840 under the exit section. The bolted flanges provide sufficient support so that the runway section (103) may span from the seat to the exit. A person of ordinary skill will readily understand that other conventional support structures, or a support structure similar to the one in the two-turn embodiment, may be used.

Although the invention has been described with respect to specific embodiments, persons of ordinary skill in the art will readily understand that the inventive concept may be applied to a variety of configurations.

What is claimed is:

1. A swimming pool slide having a ladder connected to a slide body seat segment, a slide body runway segment and a slide body exit segment, the runway segment comprising a pair of oppositely curved sections wherein an upslide end of each curved section matches for attachment to the seat segment, a downslide end of each curved section matches for attachment to the exit segment and the downslide end of either curved section matches for attachment to the upslide end of the other curved section, wherein the curved sections each have an integral runway rail on a concave side that remains a constant height and an integral runway rail on a convex side that is approximately the same height as the concave side rail at the upslide end and the downslide end and transitions to approximately twice the height of the concave side rail midway between the upslide end and the downslide end.

2. The slide of claim 1, wherein the curved sections each turn through an arc of approximately 62 degrees.

3. The slide of claim 1, wherein the downslide end of the seat segment and the downslide ends of the curved sections include a plurality of protruding bosses and a plurality of embedded nuts, and the upslide end of the exit segment and the upslide ends of the curved sections include indentations for mating with the bosses and apertures aligned to the location of the embedded nuts.

4. The slide of claim 1, wherein the ladder comprises a central tube having a plurality of steps attached, each step having a generally rectangular shape and an aperture the same diameter as the tube so the step slides on the tube to the proper attachment point.

5. The slide of claim 4, wherein each step has a notch in a portion of a bottom side, which notch fits around a dowel inserted through a pair of apertures in the central tube, thus securing the step in a proper location on the tube.

6. The slide of claim 1, or 4, further including a water inlet, a water dispersal chamber, and a water distribution slot integral with the seat segment.

7. A swimming pool slide having a ladder connected to a slide body seat segment, a slide body runway segment and a slide body exit segment, the runway segment comprising a pair of oppositely curved sections wherein an upslide end of each curved section matches for attachment to the seat segment, a downslide end of each curved section matches for attachment to the exit segment and the downslide end of either curved section matches for attachment to the upslide end of the other curved section;

wherein the downslide end of the seat segment and the downslide ends of the curved sections include a plurality of protruding bosses and a plurality of embedded nuts, and the upslide end of the exit segment and the upslide ends of the curved sections include indentations for mating with the bosses and apertures aligned to the location of the embedded nuts;

wherein each curved section includes an integral stanchion receiver approximately centered underneath the curved section, a support stanchion is attached to each stanchion receiver, and the support stanchion are connected to base plates;

wherein each curved section has an integral runway rail on a concave side that remains a constant height and an integral runway rail on a convex side that is approximately the same height as the concave side rail at the upslide end and the downslide end and transitions to approximately twice the height of the concave side rail midway between the upslide end and the downslide end;

wherein the ladder comprises a central tube having a plurality of steps attached, each step having a generally rectangular shape, an aperture the same diameter as the tube, and a notch in a portion of a bottom side, which notch fits around a dowel inserted through a pair of opposing apertures in the tube; and further including a water inlet, a water dispersal chamber and a water distribution slot integral within the seat segment.

* * * * *